US008360487B2

(12) United States Patent
Sheehan et al.

(10) Patent No.: US 8,360,487 B2
(45) Date of Patent: Jan. 29, 2013

(54) LATCH ASSEMBLY, OVER-CENTER REVERSE DRAW

(75) Inventors: Howard M. Sheehan, Bloomfield, NY (US); Brian E. Simpson, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 143 days.

(21) Appl. No.: 12/783,274

(22) Filed: May 19, 2010

(65) Prior Publication Data

US 2011/0285151 A1 Nov. 24, 2011

(51) Int. Cl.

| | |
|---|---|
| ***E05B 15/02*** | (2006.01) |
| ***B65D 45/00*** | (2006.01) |
| ***B65D 45/30*** | (2006.01) |
| ***E05C 3/04*** | (2006.01) |
| ***E05C 1/04*** | (2006.01) |

(52) U.S. Cl. ..... 292/340; 292/256; 292/256.75; 292/203; 292/153

(58) Field of Classification Search ..... 292/340, 292/341, 341.14, 341.15, 341.17, 341.11, 292/341.12, 341.13, 153, 207, 204, 210, 292/256, 256.75

See application file for complete search history.

(56) References Cited

U.S. PATENT DOCUMENTS

| | | | | |
|---|---|---|---|---|
| 3,526,423 A | | 9/1970 | Newcomer | |
| 3,850,464 A | * | 11/1974 | Bisbing et al. | 292/175 |
| 4,775,175 A | * | 10/1988 | Swift | 292/307 R |
| 4,776,620 A | * | 10/1988 | Marks et al. | 292/228 |
| 4,826,221 A | * | 5/1989 | Harmon | 292/167 |
| 4,838,054 A | * | 6/1989 | Weinerman et al. | 70/208 |
| 4,858,970 A | * | 8/1989 | Tedesco et al. | 292/113 |
| 5,096,237 A | * | 3/1992 | Hotzl | 292/34 |
| 5,445,422 A | * | 8/1995 | Weinerman et al. | 292/247 |
| 6,042,156 A | * | 3/2000 | Jackson | 292/26 |
| 6,089,625 A | * | 7/2000 | Prevot et al. | 292/182 |
| 7,306,266 B2 | * | 12/2007 | Hapke et al. | 292/218 |

FOREIGN PATENT DOCUMENTS

| | | |
|---|---|---|
| EP | 0134276 | 3/1985 |
| EP | 0831200 | 3/1998 |
| FR | 671127 | 12/1929 |
| GB | 902470 | 8/1962 |

* cited by examiner

*Primary Examiner* — Thomas Beach
*Assistant Examiner* — Nathan Cumar
(74) *Attorney, Agent, or Firm* — Harness, Dickey & Pierce, PLC

(57) ABSTRACT

A latch assembly includes a housing having a cavity between first and second end walls. The housing includes first and second journal members and first and second swing arm apertures at the second end wall. A swing arm member having a joining end is positioned within the cavity having first and second swing arms connected to the joining end having portions extending freely through the first and second swing arm apertures. A keeper/catch member is rotatably connected to the first and second journal members. Keeper/catch member rotation from an orientation rotated away from a longitudinal axis defined by a portion of the first and second swing arms extending through the swing arm apertures to an orientation approximately parallel with the longitudinal axis creates an over-center locking condition for the housing and a pushing force acting through the keeper/catch member to push a first component into contact with a second component.

17 Claims, 8 Drawing Sheets

LATCH ASSEMBLY, OVER-CENTER REVERSE DRAW

FIELD

The present disclosure relates to latch assemblies using a reverse draw motion to releasably connect a first item to a second item.

BACKGROUND

This section provides background information related to the present disclosure which is not necessarily prior art.

Components such as radio units and electronic equipment are commonly connected to support frames or cabinets to promote sealing from atmospheric conditions such as water, dirt, humidity and the like. The components can be connected using releasable connectors such as latches to permit ease of disassembly for maintenance, or to release the component for easier transportation, such as when the component needs to be moved.

Known latches used for these applications commonly include a draw mechanism that operates by rotation of a latch arm which draws the component and frame toward each other to affect the releasable connection. Draw mechanism latch designs commonly require access to a side of both the component and the frame or cabinet, therefore requiring that access space be provided to initially engage a hook or catch member and for the necessary arc of rotation of the latch arm to set or release the latch.

SUMMARY

This section provides a general summary of the disclosure, and is not a comprehensive disclosure of its full scope or all of its features.

According to several embodiments of the present disclosure, a latch assembly includes a housing having a cavity created between a first end wall and a second end wall. The housing further includes a journal member extending from the second end wall, and a swing arm aperture created in the second end wall. A swing arm member having a swing arm is positioned partially within the cavity and has a portion of the swing arm extending freely through the at least one swing arm aperture and away from the housing along a longitudinal axis. A keeper/catch member is rotatably connected to the journal member and has a keeper longitudinal axis. Rotation of the keeper/catch member from an initial orientation having the keeper longitudinal axis rotated away from parallel alignment with the portion longitudinal axis to a second orientation having the keeper longitudinal axis approximately parallel with or oppositely positioned with respect to the portion longitudinal axis creates a pushing force acting through the keeper/catch member.

According to still further embodiments, rotation of the keeper/catch member from the initial orientation to the second orientation creates an over-center locking condition of the housing and a pushing force acting through the keeper/catch member. The first and second swing arms each include a pin aperture located proximate to an arm end. The pin apertures are coaxially aligned on an aperture alignment axis, whereby the pushing force created by the keeper/catch member acts against a pin slidably received through the pin apertures used to mount the latch assembly to a first component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
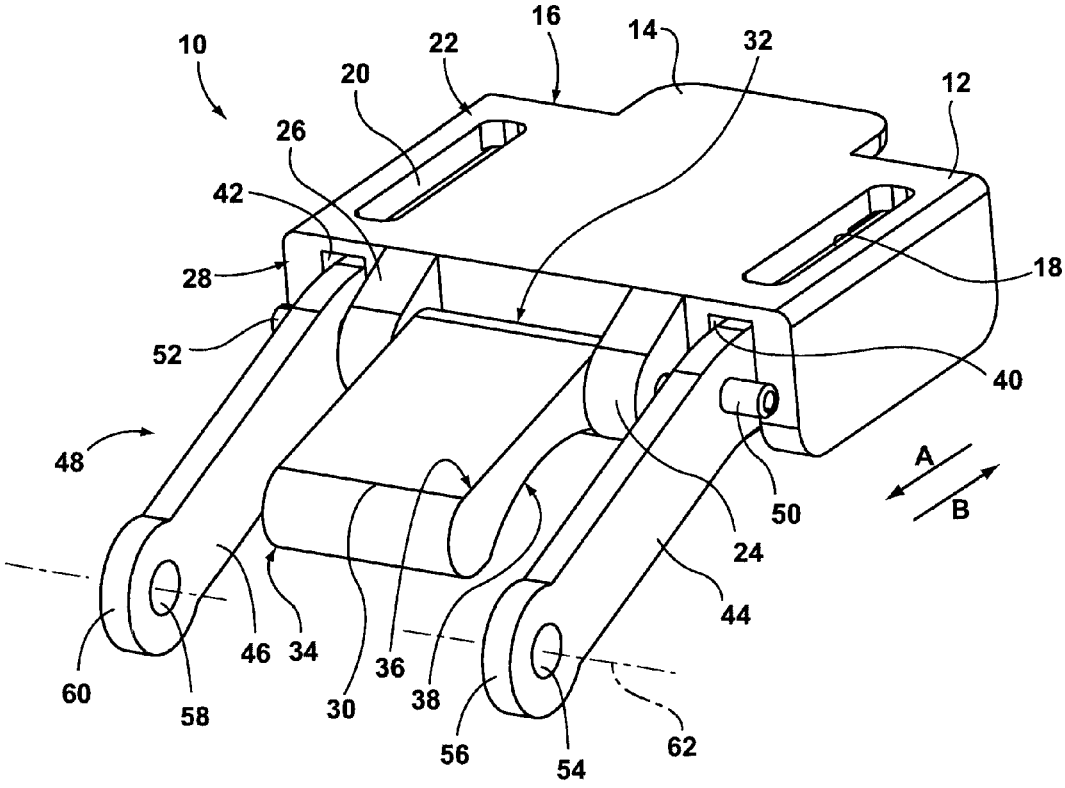
FIG. 1 is a right front perspective view of an over-center reverse draw latch assembly of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a latch assembly 10 includes a housing 12 made of a rigid material, such as a metal or molded polymeric material. Housing 12 includes a tab member 14 extending freely away from a first end wall 16. First and second elongated slots 18, 20 are created through a first housing surface 22 and are oriented substantially perpendicular to the first end wall 16. First and second journal members 24, 26 both extend away from a second end wall 28. First and second journal members 24, 26 are oriented substantially perpendicular to first and second end walls 16, 28 and are oriented substantially parallel to the first and second elongated slots 18, 20.

A keeper/catch member 30 is rotatably connected to the first and second journal members 24, 26. Keeper/catch member 30 includes a first curved surface 32 defining one end, which is oppositely positioned with respect to a second curved surface 34 defining a second end. Keeper/catch member 30 further includes a planar surface 36 oppositely oriented with respect to a concave surface 38. In use, first curved surface 32 is positioned proximate to second end wall 28 of housing 12.

First and second swing arm apertures 40, 42 are created through second end wall 28. Extending individually through the first and second swing arm apertures 40, 42 are each of a first swing arm 44 and a second swing arm 46. First and second elongated slots 18, 20 are provided for clearance when first and second swing arms 44, 46 are slidably disposed through housing 12 as they are inserted through first and second swing arm apertures 40, 42. First and second swing arms 44, 46 form a portion of a swing arm member 48. After inserting the first and second swing arms 44, 46 through the first and second swing arm apertures 40, 42, a first roll pin 50 is inserted through first swing arm 44 and, similarly, a second roll pin 52 is inserted through second swing arm 46. First and second roll pins 50, 52 prevent the release of first and second swing arms 44, 46 following their insertion in a swing arm extension direction "A" by an opposite motion in a retraction direction "B". First swing arm 44 further includes a first pin aperture 54 oriented substantially perpendicular to first swing arm 44 and created in a first semicircular end 56. Similarly, a second pin aperture 58 is created in second swing arm 46 at a second semicircular end 60 of second swing arm 46. The first and second pin apertures 54, 58 are coaxially aligned on an aperture alignment axis 62.

Figure 2:
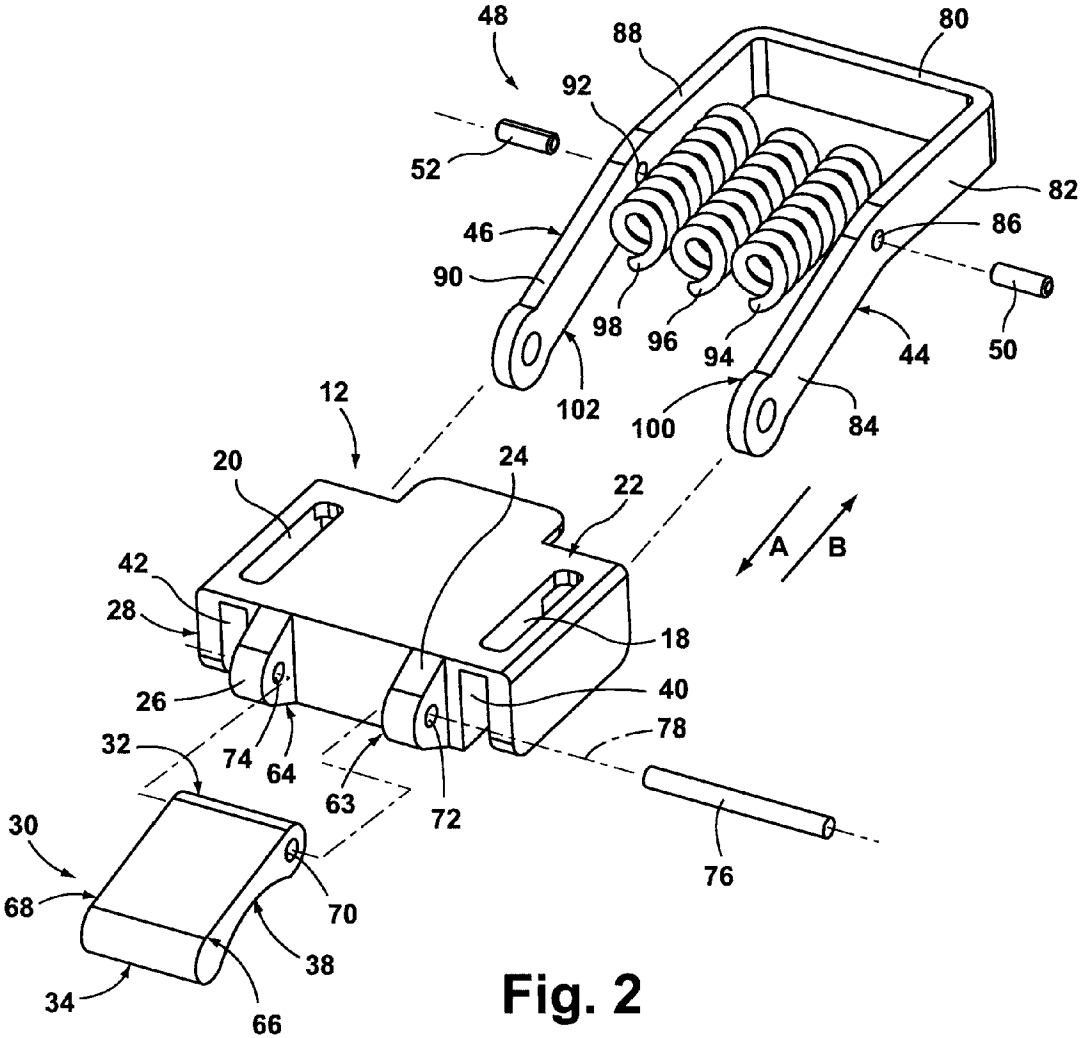
FIG. 2 is an assembly view of the latch assembly of FIG. 1.

Referring to FIG. 2, first journal member 24 provides a first journal wall 63, and second journal member 26 provides a second journal wall 64 wherein first and second journal walls 63, 64 are parallel to each other and face each other. A spacing between first and second journal walls 63, 64 is predetermined to slidably and rotatably receive keeper/catch member 30 such that a first keeper edge 66 is positioned proximate to first journal wall 63 and a second keeper edge 68 is positioned proximate to second journal wall 64. An elongated through bore 70 is created proximate to first curved surface 32. Each of the first and second journal members 24, 26 are also provided with a first and second journal through bore 72, 74 which, when coaxially aligned with elongated through bore 70 of keeper/catch member 30, can slidably receive a keeper retention pin 76. Keeper/catch member 30 thereafter is rotatable about a keeper axis of rotation 78 defined through keeper retention pin 76. A length of keeper retention pin 76 is selected such that free ends of keeper retention pin 76 extend beyond and outwardly of the first and second journal members 24, 26 but do not encroach within a space envelope required for first and second swing arms 44, 46 as they extend through first and second swing arm apertures 40, 42. Keeper/catch member 30 is therefore rotatably connected to housing 12 using keeper retention pin 76 before first and second swing arms 44, 46 are inserted through first and second swing arm apertures 40, 42.

Following the rotational connection of keeper/catch member 30 to housing 12, the first and second swing arms 44, 46 of swing arm member 48 are slidably inserted in the swing arm extension direction "A" and extend through first and second swing arm apertures 40, 42, respectively. A joining end 80, is oriented substantially perpendicular to each of first and second swing arms 44, 46 and together with first and second swing arms 44, 46 define a substantially U-shape for swing arm member 48. Swing arm member 48 can be made of a metal material or a polymeric material molded in the shape shown.

Each of the first and second swing arms 44, 46 are divisible into two portions. First swing arm 44 includes a first arm first portion 82 and a first arm second portion 84. A first arm mid aperture 86 is created substantially between first arm first portion 82 and first arm second portion 84. Second swing arm 46 is similarly created having a second arm first portion 88 and a second arm second portion 90 with a second arm mid aperture 92 created between the portions. First and second arm mid apertures 86, 92 individually receive the first and second roll pins 50, 52 after first arm second portion 84 and second arm second portion 90 extend through the first and second swing arm apertures 40, 42 and outwardly with respect to second end wall 28. The proximity of the first and second swing arms 44, 46 to opposite ends of keeper retention pin 76 prevent keeper retention pin 76 from sliding free from either of first or second journal members 24, 26.

Prior to inserting swing arm member 48 into housing 12, a biasing member is provided which can contact joining end 80 and abut against second end wall 28. According to several embodiments, the biasing member can include first, second, and third biasing members 94, 96, 98. First, second, and third biasing members 94, 96, 98 are positioned between opposed first and second swing arm inner walls 100, 102 and can contact joining end 80. First, second, and third biasing members 94, 96, 98 are shown as compression springs but can also be biasing members of differing designs. As non-limiting examples only, the biasing members can be leaf springs or a resilient material such as a rubber material able to longitudinally compress similar to the deflection of a compression spring.

Once the first and second spring arms 44, 46 are received through housing 12, opposite ends of the biasing members contact joining end 80 and can contact or be positioned proximate to second end wall 28 of housing 12. Compression of the biasing members therefore permits continued extension of the first and second swing arms 44, 46 in the swing arm extension direction "A" until a compression limit of the biasing members is reached.

Figure 3:
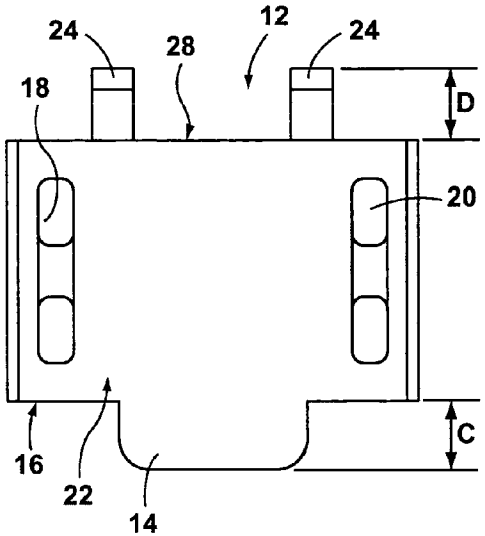
FIG. 3 is a top plan view of a housing of the latch assembly of FIG. 1.

Referring to FIG. 3, tab member 14 extends freely away from first end wall 16 of housing 12 by a tab extension length "C". Tab extension length "C" is selected to permit a user of the latch assembly 10 to position at least one finger in contact with tab member 14 to use tab member 14 as a release device when removal of the latch assembly is desired. This feature will be more thoroughly discussed with reference to FIGS. 14 and 15. Each of the first and second journal members 24, 26 extend freely away from second end wall 28 of housing 12 by a journal extension length "D". Journal extension length "D" is selected to provide rotational clearance for keeper/catch member 30 shown and described with reference to FIGS. 1 and 2.

Figure 4:
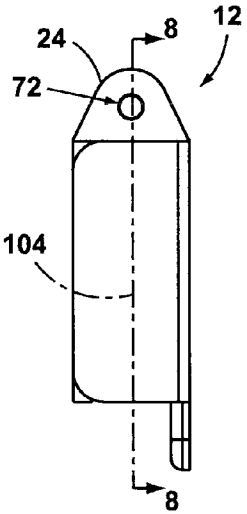
FIG. 4 is a side elevational view of the housing of FIG. 3.

Referring to FIG. 4, the first journal through bore 72 of first journal member 24 is coaxially aligned with a housing central longitudinal axis 104 of housing 12. The second journal through bore 74 of second journal member 26, which is not clearly visible in this view, is also similarly coaxially aligned with longitudinal axis 104.

Figure 5:
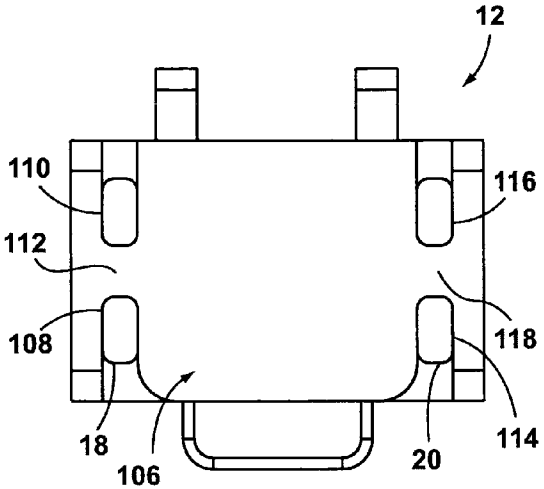
FIG. 5 is a bottom plan view of the housing of FIG. 3.

Referring to FIG. 5, a second housing surface 106, which is oppositely positioned with respect to first housing surface 22, provides slots which align with each of the first and second elongated slots 18, 20 created through first housing surface 22. These slots include a second surface first slot 108 coaxially aligned with a second surface second slot 110 having a first land 112 separating the second surface first and second slots 108, 110. Second surface first and second slots 108, 110 are coaxially aligned with first elongated slot 18. Similarly, a second surface third slot 114 is coaxially aligned with a second surface fourth slot 116 having a second land 118 spatially separating the second surface third and fourth slots 114, 116. Second surface third and fourth slots 114, 116 are coaxially aligned with second elongated slot 20.

Figure 6:
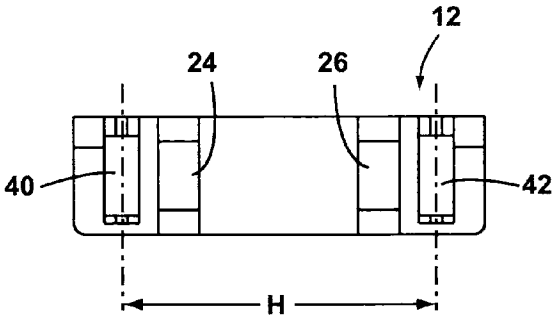
FIG. 6 is a rear end elevational view of the housing of FIG. 3.

Referring to FIG. 6, the first and second journal members 24, 26 are both positioned between the first and second swing arm apertures 40, 42. The first and second swing arm apertures 40, 42 are substantially rectangular in shape (although this shape is not limiting) and are oriented parallel to first and second journal members 24, 26.

Figure 7:
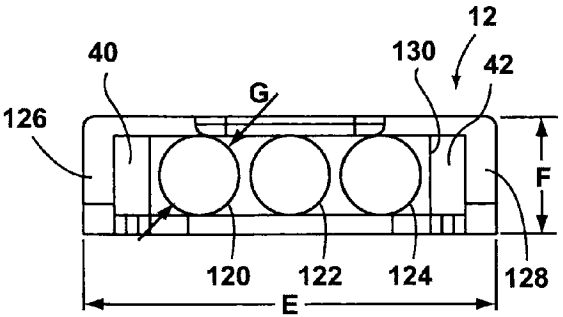
FIG. 7 is a front end elevational view of the housing of FIG. 3.

Referring to FIG. 7 and again to FIG. 2, a chamber can be provided to receive each of the individual biasing members shown and described with reference to FIG. 2. For example, when the biasing members are substantially tubular in shape, such as the shape of compression springs, the chambers can be provided as first, second, and third chambers 120, 122, 124, each having a chamber diameter "G" and each oriented substantially parallel to the other chambers such that the first, second, and third chambers 120, 122, 124 individually slidably receive one of the biasing members. The biasing members can also have different diameters, therefore the chambers can have different diameters. The first, second, and third chambers 120, 122, 124 are all positioned between a housing first outer wall 126 and an oppositely located housing second outer wall 128 of housing 12. The housing first and second outer walls 126, 128 define a biasing member cavity 130, which can include the first, second, and third chambers 120, 122, 124. The biasing member cavity 130 can be substantially free of individual chambers in the event that the biasing members are not substantially tubular in shape, and therefore to match the geometry of the biasing member selected. A housing width "E" and a housing height "F" of housing 12 are minimized based on the chamber diameter "G" for each of the first, second, and third chambers 120, 122, 124.

Figure 8:
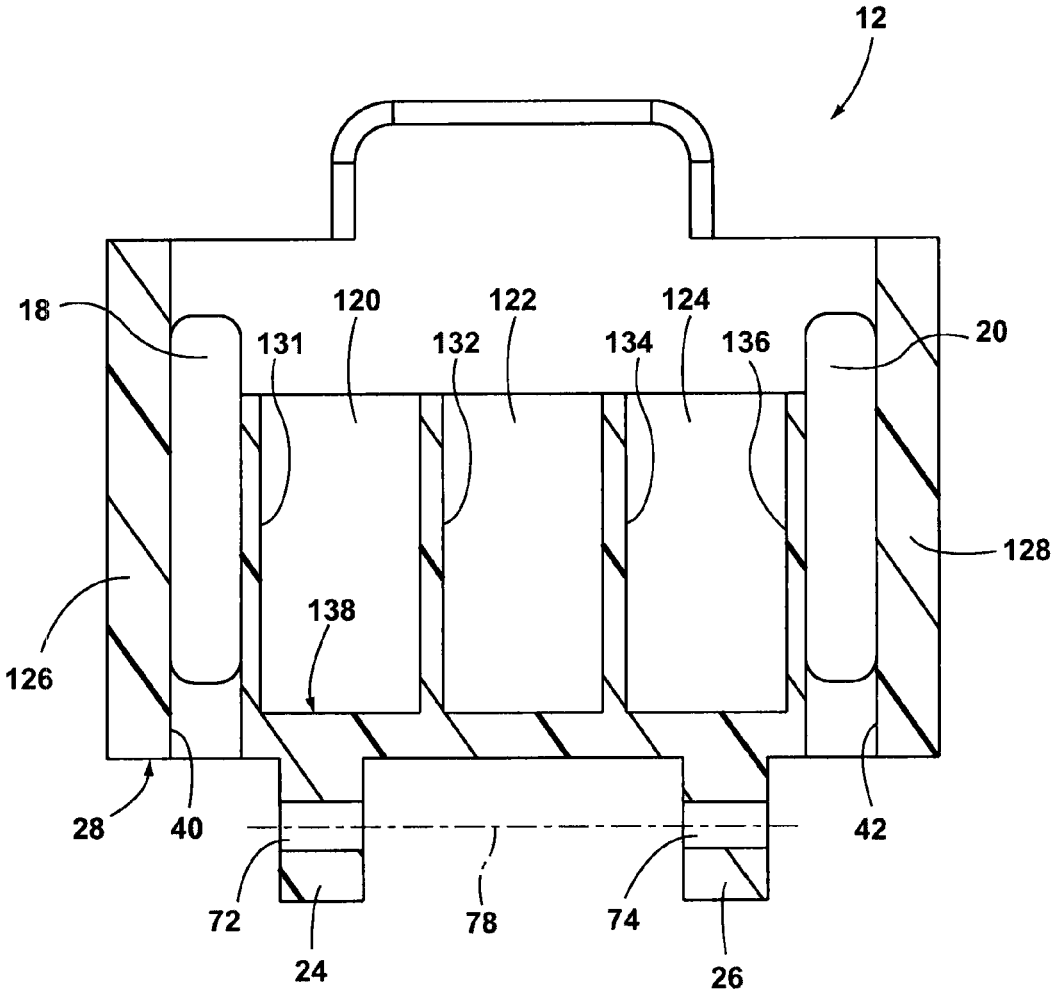
FIG. 8 is a cross sectional plan view at section 8 of FIG. 4.

Referring to FIG. 8, in order to separate each of the first, second, and third chambers 120, 122, 124, housing 12 can be provided with a first inner wall 131 and a second inner wall 132, which define the first chamber 120 therebetween. The second chamber 122 can be positioned between second inner wall 132 and a third inner wall 134. Similarly, the third chamber 124 can be positioned between third inner wall 134 and a fourth inner wall 136. Each of the biasing members when slidably received within the various chambers can contact a second end inner wall 138 of second end wall 28. As clearly evident in FIG. 8, the first and second elongated slots 18, 20 are positioned outward of the first inner wall 131 and the fourth inner wall 136, respectively, and within the envelope of the housing first and second outer walls 126, 128.

With continued reference to FIG. 8 and again to FIGS. 1, 2, 5 and 7, the first and second swing arms 44, 46 are slidably disposed between housing first outer wall 126 and first inner wall 131 and similarly between housing second outer wall 128 and fourth inner wall 136. This permits the first and second swing arms 44, 46 to be angled as they are inserted through the housing 12 such that portions of the first or second swing arms 44, 46 can temporarily extend at least partially through either first or second elongated slots 18, 20 as the swing arms are inserted through their respective first or second swing arm apertures 40, 42. One of the purposes for first and second elongated slots 18, 20 is therefore to provide additional clearance for insertion of the swing arms, which permits the height "F" of housing 12 to be further minimized. With specific reference again to FIG. 5, the second surface first and second slots 108, 110 and second surface third and fourth slots 114, 116 also provide a similar clearance function for insertion of the first and second swing arms 44, 46.

Figure 9:
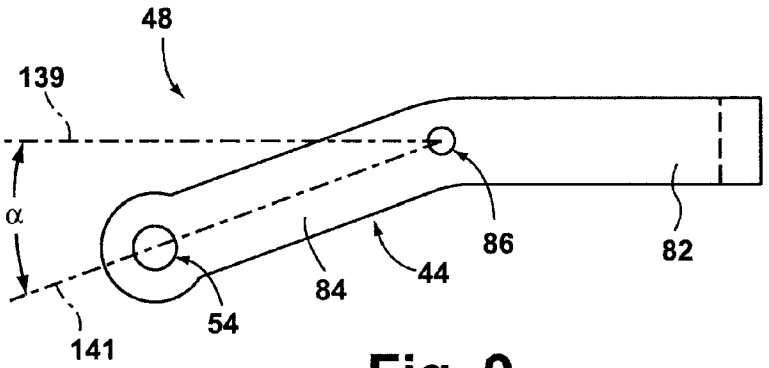
FIG. 9 is a side elevational view of a swing arm member of the present disclosure.

Referring to FIG. 9, each of the first and second swing arms 44, 46 (only first swing arm 44 is clearly visible in this view) are bent or formed such that the first arm second portion 84 is angularly oriented with respect to the first arm first portion 82. A swing angle $\alpha$ is defined between a longitudinal axis 139 of first arm first portion 82 and a central longitudinal axis 141 through first arm mid aperture 86 and first pin aperture 54 of first arm second portion 84. Swing angle α can vary from approximately five degrees to approximately 25 degrees at the discretion of the manufacturer, and is provided to help create an over-center locking condition for the latching assembly, which will be described in greater detail with further reference to FIGS. 14 and 15. Second swing arm 46, which is not clearly visible in this view, is similarly oriented.

Figure 10:
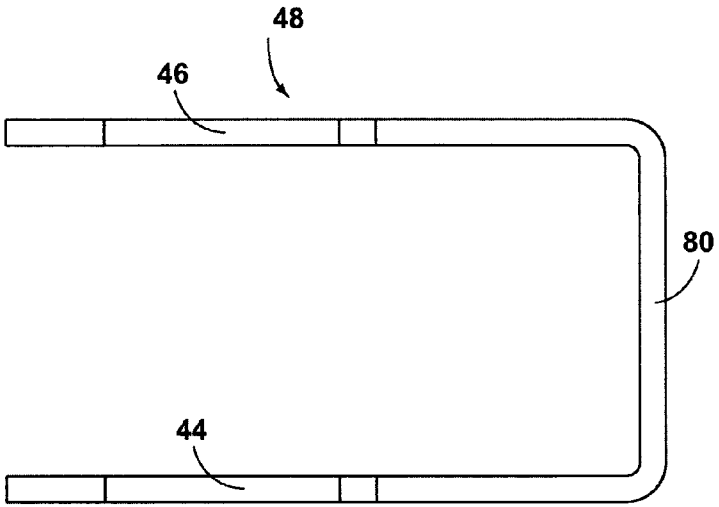
FIG. 10 is a top plan view of the swing arm member of FIG. 9.

Referring to FIG. 10, first and second swing arms 44, 46 are homogeneously connected and integrally extend from joining end 80 of swing arm member 48. First and second swing arms 44, 46 are oriented substantially perpendicular to joining end 80.

Figure 11:
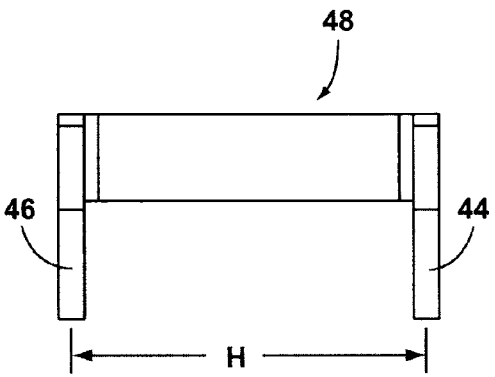
FIG. 11 is a front elevational view of the swing arm member of FIG. 9.

Referring to FIG. 11 and again to FIG. 6, the first and second swing arms 44, 46 are separated by a swing arm spacing dimension "H", which equals a similar spacing dimension between the first and second swing arm apertures 40, 42 shown and described with reference to FIG. 6. This ensures the swing arms can be slidably received in the swing arm apertures with minimal friction.

Figure 12:
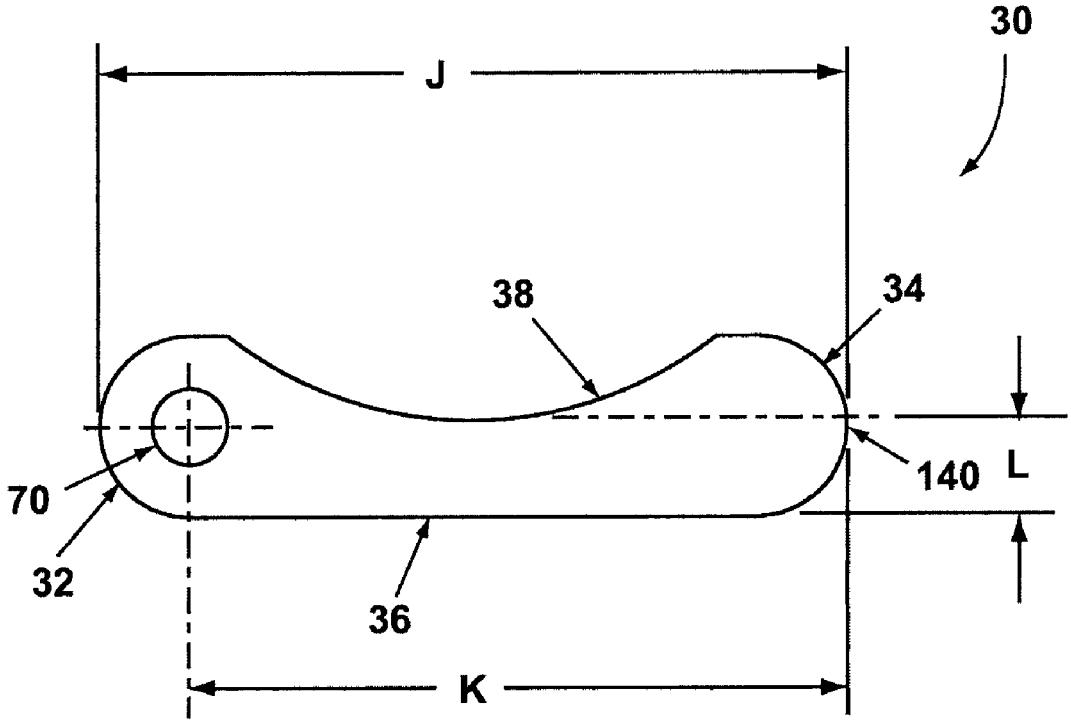
FIG. 12 is side elevational view of a keeper/catch member of the present disclosure.

Referring to FIG. 12, keeper/catch member 30 has the concave surface 38 oppositely facing with respect to planar surface 36. The curvature of concave surface 38 stops before overlapping with either of the first or second curved surfaces 32, 34. A keeper length "J" can be modified to provide an increasing or decreasing pushing force, which is described in greater detail in reference to FIGS. 14 and 15. The elongated through bore 70 is spaced at an aperture locating dimension "K" with respect to a curve apex 140 of second curved surface 34. A minimum thickness "L" is provided by precluding the concave surface 38 from contacting or overlapping either of the first or second curved surfaces 32, 34.

Figure 13:
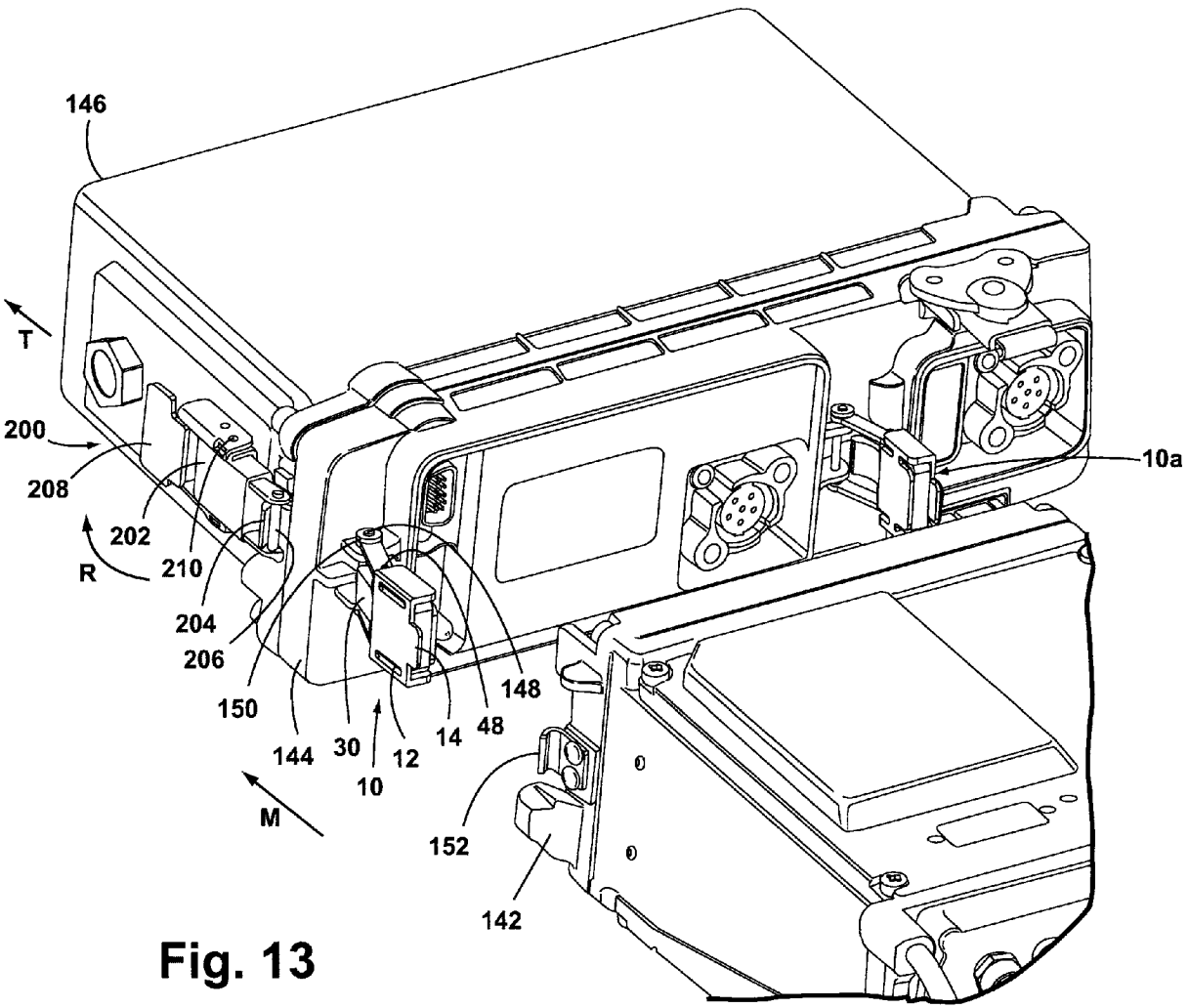
FIG. 13 is a left front perspective view of a component assembly using latch members of the present disclosure.

Referring to FIG. 13 and again to FIGS. 1, 2, and 9, latch assemblies 10 provide an opposite reverse draw actuation force (i.e., a pushing force acting to push a first component into contact with a second component) than provided with commonly known latch assemblies, such as latch assembly 200 which operate using a pulling force operating to pull components into contact with each other. This permits latch assemblies 10 to be relocated away from the side or edge surfaces of components to be joined, which can be an operational limitation for use of latch assemblies 200. In the embodiments shown, latch assembly 10 is oriented such that a pin 148 can be slidably received through first and second pin apertures 54, 58 of first and second swing arms 44, 46 of swing arm member 48 and retained by at least one push washer 150. This permits rotation of latch assembly 10 with respect to pin 148. Latch assemblies 10 can be used to releasably join or couple components, such as a communication component 142 (for example, a radio unit), to a back plane assembly 144 connected to a battery pack 146. Latch assemblies 10 therefore allow communication component 142 to be releasably connected with respect to back plane assembly 144. A hook member 152 can be fixedly connected to communication component 142. The hook member 152 will be pushed by contact with keeper/catch member 30 to push communication component 142 in the pushing direction "M" into engaged contact with back plane assembly 144.

Commonly known latch assemblies, such as latch assembly 200, act oppositely with respect to latch assemblies 10 of the present disclosure. Latch assemblies 200 act by pulling a first component, such as back plane assembly 144, into engagement with the second component, such as battery pack 146. To accomplish this, latch assemblies 200 include a latch body 202, which is fixedly connected to battery pack 146. A hook member 204, similar to hook member 152, is fixedly connected to communication component 142. Latch assembly 200 operates by engaging a latch pin 206, which is translated by rotation of a lever arm 208 with respect to an arc of rotation "R". Lever arm 208 is rotatably connected to latch body 202 using a lever arm pin 210. By rotating the lever arm 208 about arc of rotation "R", latch pin 206 provides a pulling force with respect to hook member 204, which pulls back plane assembly 144 in a pull direction "T", which can be substantially parallel to pushing direction "M". The configuration of latch assembly 200 normally prevents its use when connected to an end face of a component and, therefore, generally limits the use of latch assemblies 200 to applications where the latch assembly is coupled to components that are oriented substantially parallel and co-planar to each other.

Referring to FIG. 14 and again to FIGS. 1, 2, and 9, the assembly of communication component 142 to back plane assembly 144 and battery pack 146 using latch assembly 10 can proceed as follows. Initially, communication component 142 is manually pushed in the pushing direction "M" by manually applied force until communication component 142 contacts a seal member 154 positioned between communication component 142 and back plane assembly 144. Further manual pushing of communication component 142 would be insufficient to fully seat the seal member 154, therefore a mechanical latching device is required both to fully seat the seal member 154 and to releasably retain the engagement of communication component 142 to back plane assembly 144.

Figure 14:
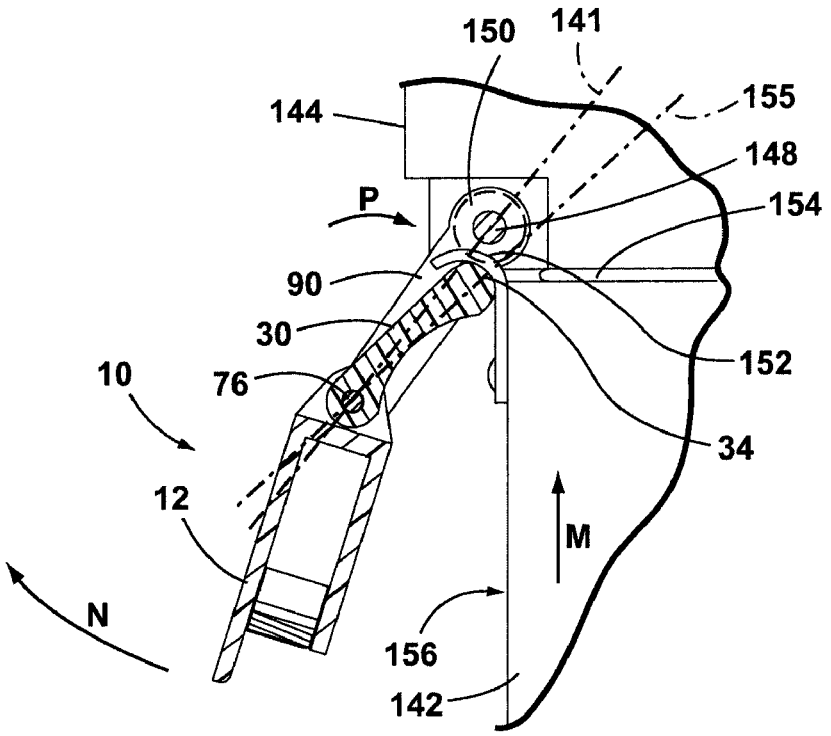
FIG. 14 is a partial cross sectional plan view of the components of FIG. 13 during a latching operation.
Figure 15:
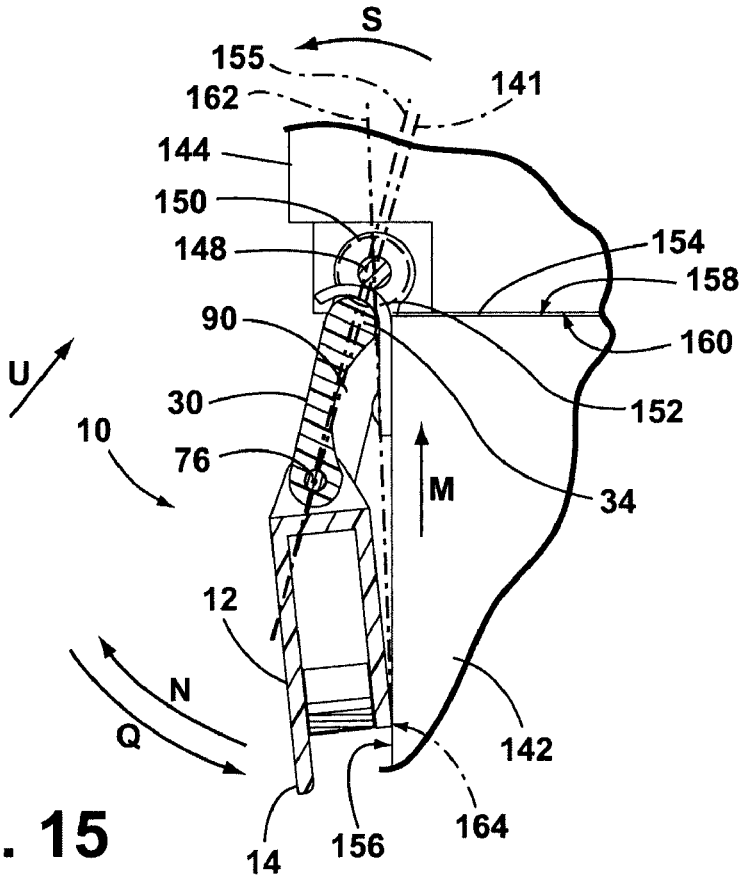
FIG. 15 is a partial cross sectional plan similar to FIG. 14 further showing a fully latched and over-center locked condition of the latching assembly.

Housing 12 is oriented in an initial position as shown in FIG. 14, by rotating housing 12 in a release arc of rotation "N" with respect to a longitudinal axis of pin 148. This provides clearance for the user to manually rotate keeper/catch member 30 in an engagement arc of rotation "P" with respect to axis of rotation 78 defined by keeper retention pin 76 until second curved surface 34 of keeper/catch member 30 contacts the inner loop portion of hook member 152 as shown. In the initial position, a longitudinal axis 155 of keeper/catch member 30 is rotated away from (and therefore not oriented parallel to) longitudinal axis 141 of second arm second portion 90. First arm second portion 84 (not shown for clarity) also includes a longitudinal axis 141' (not shown for clarity) which is aligned in parallel with longitudinal axis 141. Also, in the initial installation position housing 12 is freely separated from a component outer wall 156 of communication component 142.

Referring to FIG. 15 and again to FIGS. 1, 2, and 9, to complete the installation of latch assembly 10, the user rotates housing 12 about a latching arc of rotation "Q" until housing 12 contacts component outer wall 156 of communication component 142 defining a second position. This rotation of housing 12 causes keeper/catch member 30 to rotate in an opposite rotation direction defined by a keeper direction of rotation "S". Housing 12 is rotated together with keeper/catch member 30 until second curved surface 34 is brought to a position which is aligned substantially parallel with longitudinal axis 155 defined through retention pin 76 and pin 148, having longitudinal axis 155 positioned substantially parallel with longitudinal axis 141, or over-rotated in direction of rotation "S" by up to approximately 10 degrees beyond longitudinal axis 141. Rotation of keeper/catch member 30 creates a force "U" having a component acting in the pushing direction "M" between keeper/catch member 30 and hook member 152, providing mechanical force to push or displace communication component 142 in the pushing direction "M" to fully seat the seal member 154.

Latch assembly 10 can also bring a communication component engagement surface 158 of communication component 142 close to or substantially in contact with a back plane engagement surface 160 of back plane assembly 144. Because of the angular orientation of the swing arms 44, 46 (only second arm second portion 90 of second swing arm 46 is visible in this view), an over-center locked condition is created when housing 12 contacts component outer wall 156, which resists the release of latch assembly 10 until the user manually pulls tab member 14 in the release arc of rotation "N". The over-center locked condition is achieved because in the latched condition of latch assembly 10, keeper retention pin 76 is positioned outboard or away from a line of action 162 extending through the longitudinal axis of pin 148 and a point of contact 164 between housing 12 and component outer wall 156.

Latch assembly 10 includes housing 12 having cavity 130 created between first end wall 16 and second end wall 28 of the housing 12. The housing 12 further includes first and second journal members 24, 26 extending from the second end wall 28; first and second swing arm apertures 40, 42 created in the second end wall 28; and tab member 14 extending away from the first end wall 16. Swing arm member 48 has joining end 80 positioned within the cavity 120 and has first and second swing arms 44, 46 integrally connected to the joining end 80 each having the portion 84, 90 extending freely through one of the first and second swing arm apertures 40, 42 and away from the housing 12. The portions 84, 90 each have their portion longitudinal axes 141, 141' aligned parallel to each other. Keeper/catch member 30 is rotatably connected to the first and second journal members 24, 26 and has keeper longitudinal axis 155. Rotation of the keeper/catch member 30 from an initial orientation having the keeper longitudinal axis 155 rotated away from parallel alignment with the portion longitudinal axis 141, 141' of the first and second swing arms 44, 46 to a second orientation having the keeper longitudinal axis 155 aligned approximately parallel with the portion longitudinal axis 141, 141' of the first and second swing arms 44, 46 by rotation of the housing 12 using the tab member 14, creating the over-center locking condition and creating pushing force "M" acting through the keeper/catch member 30.

Referring again to FIGS. 2, 14, and 15, the use of biasing members, such as first, second, and third biasing members 94, 96, 98, also assists in the over-center locking condition for latch assembly 10. This occurs because, as housing 12 is rotated in the latching arc of rotation "Q" causing the keeper/catch member 30 to create pushing force "U", rotation of housing 12 acts to partially compress the biasing members. The biasing force thus produced can be stored to further supplement the over-center locking capability of latch assemblies 10.

Latch assemblies 10 of the present disclosure offer several advantages. By use of the over-center alignment provided by latch assemblies 10, a closed or latched position will remain in the closed or latched position until manually released by a user. The orientation of keeper/catch member 30 rotatably connected using keeper retention pin 76 causes a pushing force to be applied against a hook member such that a component to be joined is pushed into engagement with a second component in lieu of being pulled into contact, which is common with known latch assemblies. Latch assemblies 10 also permit installation of at least one end of the latch assembly to a component face, which is perpendicularly oriented with respect to the second component outer wall. This provides for greater flexibility of use for latch assemblies 10.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A latch assembly, comprising:

a housing having opposed and parallel first and second end walls defining a cavity created between the first and second end walls, the housing further including:

first and second journal members integrally and outwardly extending from the second end wall outside of the housing, each having a through bore in coaxial alignment with each other and axially aligned with a central longitudinal axis of the housing; and first and second swing arm apertures created in the second end wall each outward of one of the first or second journal members;

a U-shaped swing arm member having a joining end continuously positioned in the cavity and positioned proximate to the first end wall, and first and second swing arms integrally connected to and perpendicularly oriented with respect to the joining end, each having a first portion continuously positioned in the cavity and a second portion fixed to the first portion and angularly oriented at a swing angle with respect to the first portion, the second portion extending freely through one of the first and second swing arm apertures and slidable toward and away from the housing by sliding motion of the first portion of the first and second swing arms and the joining end parallel with the central longitudinal axis of the housing;

a keeper/catch member rotatably connected to the first and second journal members;

a biasing member positioned in the cavity aligned in parallel with the central longitudinal axis of the housing directly and oppositely contacting each of the joining end of the swing arm member and the second end wall of the housing such that the biasing member is normally acting to pull the second portion of the first and second swing arm members toward the housing, and is compressed as the second portion of the first and second swing arms extend away from the housing; and the second portion of both the first and second swing arms each including a pin aperture located proximate to an arm end and both receiving a pin acting to rotatably mount the second portion of both the first and second swing arms to a first component.

2. The latch assembly of claim 1, wherein the keeper/catch member rotatably is positioned outside of the housing and between the second portions of the first and second swing arm members, the keeper/catch member having a keeper longitudinal axis.

3. The latch assembly of claim 2, wherein rotation of the housing with respect to the pin thereby rotates the keeper/catch member from an initial orientation having the keeper longitudinal axis rotated away from parallel alignment with respect to a second portion longitudinal axis of the first and second swing arms to a second orientation having the keeper longitudinal axis oriented between approximately parallel with to approximately ten degrees over-rotated with respect to the second portion longitudinal axis.

4. The latch assembly of claim 3, wherein rotation of the keeper/catch member creates a pushing force through the keeper/catch member in contact with a second component acting to push the second component toward the first component and also acting through the keeper/catch member and the housing to create an over-center locking condition of the housing and to pull the second portion of both the first and second swing arms further away from the first and second swing arm apertures thereby compressing the biasing member to retain the over-center locking condition.

5. The latch assembly of claim 1, wherein the housing further includes:

a first housing surface having first and second elongated slots;

a second housing surface oppositely positioned with respect to the first housing surface having a second surface first slot coaxially aligned with a second surface second slot and a first land separating the second surface first and second slots, the second surface first and second slots coaxially aligned with the first elongated slot; and a second surface third slot coaxially aligned with a second surface fourth slot and a second land spatially separating the second surface third and fourth slots, the second surface third and fourth slots coaxially aligned with second elongated slot;

each of the slots acting to temporarily receive the second portion of the first and second swing arms during insertion of the first and second swing arms into the housing cavity.

6. A latch assembly, comprising:

a housing having opposed and parallel first and second end walls defining a cavity created between the first and second end walls, the housing further including:

first and second journal members integrally and outwardly extending from the second end wall, each having a through bore coaxially aligned with a central longitudinal axis of the housing; and first and second swing arm apertures created in the second end wall each outward of one of the first or second journal members;

a U-shaped swing arm member having a joining end positioned proximate to the first end wall within the cavity and first and second swing arms integrally connected to and perpendicularly oriented with respect to the joining end, each having a first portion positioned in the cavity and a second portion fixed to the first portion and angularly oriented at a swing angle with respect to the first portion, the second portion extending freely through one of the first and second swing arm apertures and slidable toward or away from the housing, each portion having a portion longitudinal axis;

a keeper/catch member positioned between the first and second swing arm members and rotatably connected to the first and second journal members, the keeper/catch member having a keeper longitudinal axis;

a biasing member positioned in the cavity aligned in parallel with the central longitudinal axis of the housing and oppositely contacting each of the joining end of the swing arm member and the second end wall of the housing such that the biasing member is normally acting to push the joining end toward the first end wall, thereby pulling the second portion of the first and second swing arm members toward the housing, and is compressed as the second portion of the first and second swing arms extend away from the housing; and the second portion of both the first and second swing arms, each including a pin aperture located proximate to an arm end receiving a pin to mount the second portion of both the first and second swing arms to a first component;

wherein rotation of the housing with respect to the pin thereby rotates the keeper/catch member from an initial orientation having the keeper longitudinal axis rotated away from parallel alignment with respect to the second portion longitudinal axis of the first and second swing arms to a second orientation having the keeper longitudinal axis oriented approximately parallel with the second portion longitudinal axis creating a pushing force through the keeper/catch member acting to push a second component toward the first component and acting through the keeper/catch member and the housing creating an over-center locking condition of the housing and to pull the second portion of both the first and second swing arms further out of the first and second swing arm apertures, thereby compressing the biasing member to retain the over-center locking condition.

7. The latch assembly of claim 6, further including a first arm mid aperture created between the first arm first and second portions, and a second arm mid aperture created between the second arm first and second portions, the first and second arm mid apertures individually receiving first and second roll pins after the first arm second portion and the second arm second portion extend through the first and second swing arm apertures, and wherein the pin apertures of each of the first and second swing arms are coaxially aligned on an aperture alignment axis spatially separated from the first and second arm mid apertures.

8. The latch assembly of claim 6, whereby the pushing force created by the keeper/catch member acts against a pin slidably received through the pin apertures used to mount the latch assembly to a first component.

9. The latch assembly of claim 6, wherein the first portions of each of the first and second swing arms are slidable within the cavity during displacement of the joining end.

10. The latch assembly of claim 6, wherein the first and second journals individually include first and second coaxially aligned through bores axially aligned with the housing central longitudinal axis.

11. The latch assembly of claim 6, further including a hook member fixed to the second component, wherein the keeper/catch member includes a curved end surface adapted to rotatably engage with the hook member in the orientation rotated away from the longitudinal axis, and the housing is rotatable to orient the keeper/catch member in the orientation approximately parallel with the longitudinal axis to create the pushing force acting through the keeper/catch member acting to push the second component into contact with the first component.

12. The latch assembly of claim 6, wherein the over-center locked condition is achieved in the latched condition of latch assembly by positioning a keeper retention pin outboard of a line of action extending through the longitudinal axis of the pin and a point of contact between the housing and an outer wall of the second component.

13. The latch assembly of claim 12, wherein a keeper retention pin is slidably received through the through bore of the first journal member, through an elongated through bore of the keeper/catch member, and through the through bore of the second journal member to rotatably connect the keeper/catch member to the first and second journal members, the line of action positioned between the retention pin and the outer wall of the second component in the over-center locked condition.

14. The latch assembly of claim 13, wherein a proximity of the first and second swing arms to opposite ends of the keeper retention pin prevents the keeper retention pin from sliding free from either of first or second journal members.

15. A latch assembly, comprising:

a housing including opposed and parallel first and second end walls defining a cavity therebetween, and first and second journal members positioned outside of the cavity, integrally and outwardly extending from the second end wall, each having a through bore in coaxial alignment with each other and axially aligned with a central longitudinal axis of the housing;

a swing arm member having a joining end continuously positioned in the cavity and movably located proximate to the first end wall, and first and second swing arms perpendicularly oriented with respect to the joining end each having a portion extending partially outside of the cavity slidable toward and away from the housing;

a biasing member positioned in the cavity and oppositely contacting the joining end and the second end wall, the biasing member normally acting to pull the first and second swing arm members toward the first end wall, the biasing member compressed as the joining end extends away from the first end wall; and a keeper/catch member positioned between the first and second swing arm members outside of the cavity and rotatably pinned to the through bores of the first and second journal members, the keeper/catch member having a keeper/catch member longitudinal axis that when oriented substantially parallel with a central axis of the portion of the first and second swing arms located outside of the cavity acts to extend the first and second swing arms further outward from the housing and to compress the biasing member, thereby defining a locked position, and when oriented out of alignment with the portion of the first and second swing arms allowing the biasing member to pull the first and second swing arms toward the housing defining a non-locked condition.

16. The latch assembly of claim 15, further including rectangular shaped first and second swing arm apertures created in the second end wall, each outward of one of the first or second journal members and oriented parallel to the first and second journal members.

17. The latch assembly of claim 16, wherein the portion of the swing arm member located outside of the cavity extends freely through one of the first and second swing arm apertures and is angularly oriented at a swing angle with respect to a portion located in the cavity, the swing angle thereby angularly oriented with respect to the central longitudinal axis of the housing.

* * * * *